United States Patent [19]

McGoveran

[11] 4,143,459

[45] Mar. 13, 1979

[54] CABLE CONNECTOR CRIMPING APPARATUS

[76] Inventor: David O. McGoveran, 1177 Noel Dr., Menlo Park, Calif. 94025

[21] Appl. No.: 855,820

[22] Filed: Nov. 30, 1977

[51] Int. Cl.[2] ..... H01R 43/04

[52] U.S. Cl. ..... 29/749; 29/560.1; 29/753; 29/760

[58] Field of Search ..... 29/749, 751, 753, 758, 29/760, 560.1

[56] References Cited

U.S. PATENT DOCUMENTS

| | | | |
|---|---|---|---|
| 4,005,518 | 2/1977 | Bakermans | 29/749 X |
| 4,020,540 | 5/1977 | Casciotti et al. | 29/749 |

*Primary Examiner*—Carl E. Hall
*Attorney, Agent, or Firm*—Phillips, Moore, Weissenberger, Lempio & Majestic

[57] ABSTRACT

A cable connector crimping apparatus is disclosed for use in combination with a standard vise or the like including means for positioning the apparatus on the front surface of one of the jaws of the vise, stop means for preventing the closure of the vise beyond a certain point so as to protect the connector from damage once the crimping of the connector has been completed, and including secondary spacing means for insuring that pins extending from the connector are also not damaged during the crimping of the cable onto the connector.

8 Claims, 4 Drawing Figures

FIG_1
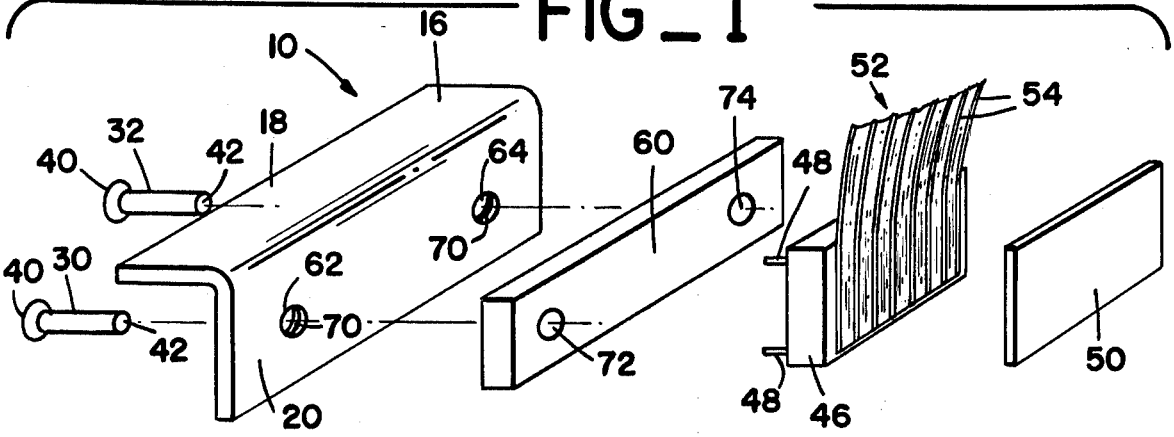
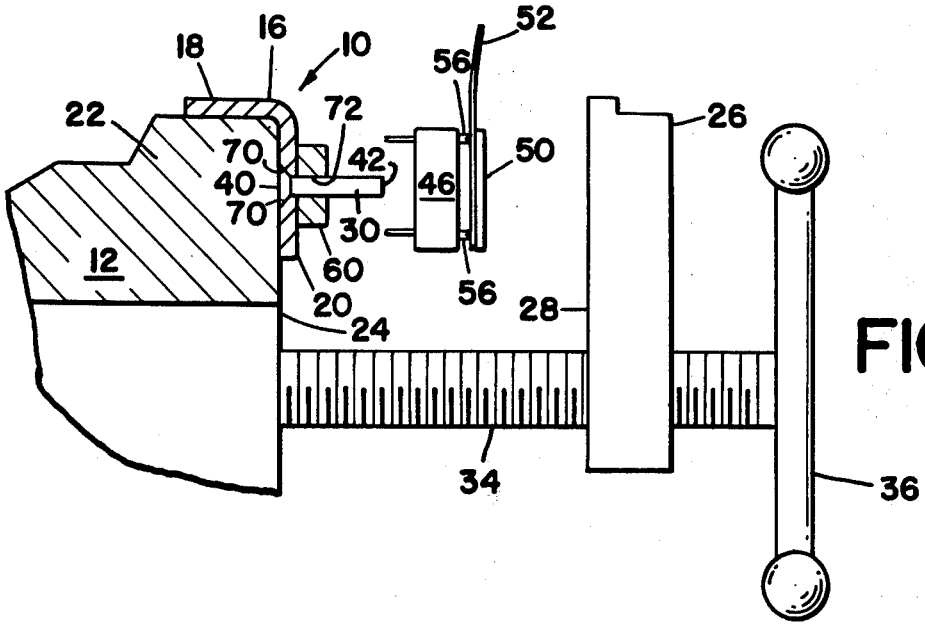
FIG_2
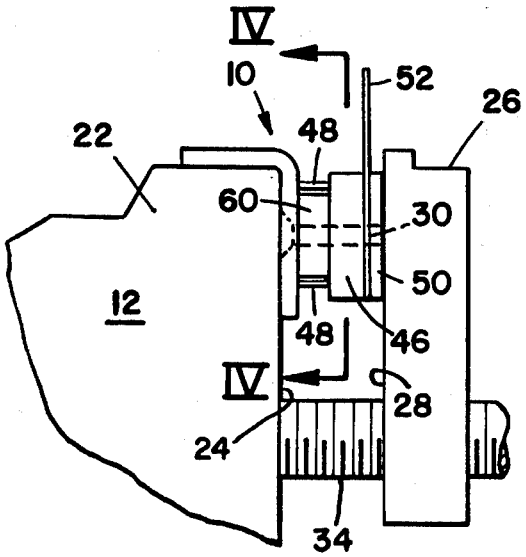
FIG_3
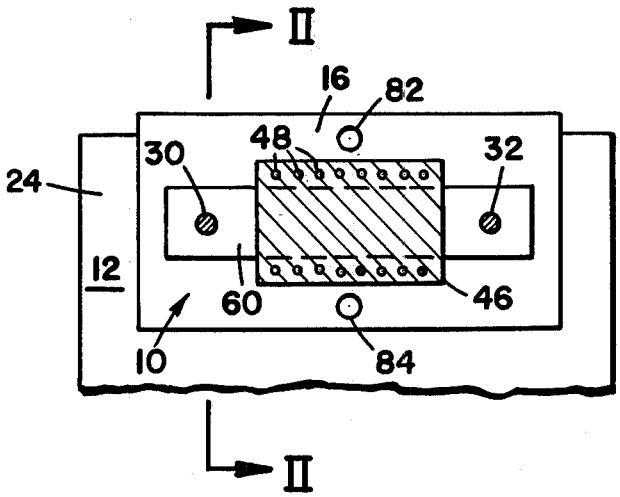
FIG_4

CABLE CONNECTOR CRIMPING APPARATUS

BACKGROUND OF THE INVENTION

An improvement in the art of cable-connector fabrication has involved the use of flat multi-conductor cables which can be conductively installed on a connector by crimping them together. This crimping enables knife edged contact terminals or binding posts on the connector to pierce the cable insulation and thereby conductively contact a conductor therein. A relatively high force is required to install the connector on the cable, especially if a large number of conductors exist on the cable, and the force must be uniformly applied to ensure satisfactory conductive contact with all conductors.

Prior art tools for performing this crimping operation to operatively join such cables to connectors have normally been hand tools which have been designed only for a particular type and size of connector. One manufacturer's connector usually does not fit on connector crimping tools made by a competing manufacturer. Further, such hand tools have generally been relatively complex devices including a number of parts to insure the proper closure of jaws on the hand tool against the connector without damaging the connector thereby during crimping. See e.g. U.S. Pat. No. 4,005,516 and U.S. Pat. No. 1,677,968, wherein such tools are disclosed. Finally, few tools are sufficiently large enough to satisfactorily crimp connectors to cables having a high number of conductors.

SUMMARY OF THE INVENTION

The present invention eliminates the need for special hand crimping tools for each type of connector and cable. The apparatus of the present invention requires only two or three components in combination with a standard vise or the like for performance of crimping operations for multi-conductor cables and connectors of various sizes.

The apparatus of the present invention includes a means for mounting and supporting the apparatus on one of the jaws of a standard vise, stop means for preventing the vise jaws from closing beyond a certain point, corresponding to the point at which crimping of the given connector has been completed, and means for the secondary spacing of the connector to prevent pins on the connector from being damaged during crimping. The present invention is also designed such that the stop means and the secondary spacing means can be easily removed and changed such that different connectors of various sizes and shapes can be efficiently crimped with the apparatus of the present invention. Even wide multi-conductor cables, e.g. flat cables having fifty or more conductors, may be easily crimped to a connector with the present invention, the vise providing the uniform application of force needed to properly create conductive contact between the connector and all conductors on the cable.

Therefore, the principal object of the present invention is to provide an improved cable connector crimping apparatus having a minimum of simple and commonly available components, and an apparatus which provides a simple means for crimping cables to connectors of various sizes and shapes, while enabling all such connectors to be successfully crimped without damage thereto.

A further object of the present invention is to provide a cable connector crimping apparatus wherein any standard vise or the like may be used in combination with the apparatus, and wherein the size of the stop means and the secondary spacing means can be quickly varied to enable different connectors to be crimped by the apparatus of the present invention.

Another object of the present invention is to provide a cable connector crimping apparatus wherein cables having only a few conductors and flat cables having a large number of conductors are equally successfully crimped to connectors using the apparatus of the present invention.

These and other objects and advantages of the present invention will become more obvious upon reference to the accompanying drawings and following description.

BRIEF DESCRIPTION OF THE DRAWINGS

FIG. 1 is a perspective view of a break out of all components of the crimping apparatus of the present invention, with cable and connector components also illustrated in a position for crimping thereby;

FIG. 2 illustrates a sectional view of the crimping apparatus of the present invention installed on a standard vise taken along the line II—II of FIG. 4, and further illustrates relative thereto the spacing of a connector and cable to be crimped;

FIG. 3 illustrates the crimping apparatus of the present invention wherein the vise jaws are at a position where crimping of the connector and cable have been completed; and FIG. 4 is a front view of the apparatus of the present invention shown partly in section and taken along the line IV—IV of FIG. 3, with a connector positioned thereon.

DESCRIPTION OF THE PREFERRED EMBODIMENT

The apparatus of the present invention is illustrated in perspective view in FIG. 1. The apparatus is also shown at 10 in FIGS. 2 and 3 operatively associated with a standard vise 12 or the like. The present invention is preferably used in combination with a standard bench vise 12, but any similar means for controlling the application of a uniform force to the crimping apparatus of the present invention and associated connector may also be used.

As seen in FIG. 1, the crimping apparatus 10 comprises a first tool portion 16 formed as an L-shaped strip or bracket portion. This first tool portion 16 includes a first side portion 18 and a second side portion 20. As seen in FIG. 2, the first tool portion 16 is shaped such that it will rest on one of the jaws 22 of the vise 12. Again as seen in FIG. 2, the second side 20 of the first tool portion 16 is positioned such that it will face the opposite front surface 28 of the second jaw 26 of the standard vise 12.

The crimping apparatus further includes stop means for preventing the vise jaws 22, 26 from closing beyond a certain position corresponding to the point at which crimping of the connector has been completed. In the present embodiment, the stop means comprises a plurality of screws, shown at 30 and 32 in FIG. 1. As seen in FIGS. 2 and 3, as the two jaws 22, 26 of the vise are caused to close towards each other in a conventional manner by means of screw 34 and handle 36, the screws 30, 32 are operatively positioned such that they prevent closure of the jaws 22, 26 beyong a certain point. The screws 30, 32 are oriented such that their heads lie flush against the front surface 24 of jaw 22, and further oriented such that the opposite end 42 of each screw is positioned to contact the front surface 28 of jaw 26, thereby preventing further closure of the jaws 22, 26 beyond that point.

A conventional connector and cable assembly is illustrated in FIG. 1. The assembly includes a connector body portion 46 including a plurality of male pins 48 extending therefrom. Note that female pins either contained within the connector body 46 or extending therefrom are also conventional types of connectors envisioned as being crimped using the apparatus of the present invention. The connector also includes a lid or cover member 50. The flat cable is shown at 52, and includes a plurality of conductors as shown at 54. The flat cable is positioned between the conductor body 46 and the end cover 50 during the crimping process. Knife edged binding posts or contact terminals 56, seen best in FIG. 2 are enabled during crimping of the cable thereon to pierce the cable insulation and thereby conductively contact one of the conductors 54 therein.

To protect the pins 48 from damage during the connector crimping process, a second tool portion 60 is also provided. This tool portion is composed of a non-compressable material such as metal. This tool portion 60 provides secondary spacing means which are operatively associated with the stop means for preventing pin damage. Tool portion 60 provides a spacer between the first tool portion 16 and the connector body 46 which allows the pins 48 to fit about or on either side of tool portion 60. Thus, when force is applied by the jaws 22, 26 against the connector, no force is experienced by the pins 48, the force being applied only to the body 46 and the cover member 50 of the connector.

As seen in FIGS. 2 and 3, the first tool portion 16 further comprises means for positioning the stop means and the secondary spacing means with respect to the front surface 24 of the jaw 22. As seen in FIG. 1, holes 62, 64 are defined in the first tool portion 16 to provide such means. These holes are sized such that the screws 30, 32 fit therein. To enable uniform and balanced transferring of force between jaws 22 and 26 and from the first tool portion 16 to the connector body 46, the heads 40 of the screws 30, 32 are flat, and the holes 62, 64 of the first tool portion 16 are countersunk, as seen at 70, such that the screws 30, 32 will be in a substantially flushed relationship with the surface of said side 20, and thus against the front surface 24 of the jaw 22.

Holes 72, 74 are also defined in the spacer 60 such that said screws 30, 32 also are enabled to extend therethrough when in position in the first tool portion 16. Consequently, the screws 30, 32 provide vertical support for the spacer 60. Further, the first tool portion 16 provides horizontal support for the spacer 60 during crimping of a connector.

FIG. 4 illustrates a partial front view of the crimping apparatus showing the position of the connector body 46 with respect to the crimping apparatus 10. As can be seen, the screws 30, 32 are each positioned with one on either side of the connector when the jaw 26 has stopped against the screws 30, 32. If a screw were only placed on one side of the connector, it is conceivable that excessive forces might build-up on the side not having a screw stop means, such that the connector would be damaged thereby. Note that a plurality of holes can be provided in the first tool portion 16 and the spacer 60, such that a plurality of connector sizes can easily be placed therebetween. For certain wider connectors, a plurality of screws for stop means might further be deemed desirable on each side of said connector or on the top and bottom side of the connector, as shown at 82, 84, for further protection of the connector.

Stop means are required in general and are a necessary aspect of the present invention. One reason for this is that connectors normally are composed of a plastic material. Such material has a definite tendency to crack or break as a result of the excessively high forces which would be generated if the jaws of the vide 12 were to close even slightly beyond the point of completed connector crimping.

FIG. 3 illustrates the crimping apparatus of the present invention wherein the vise jaws 22, 26 are positioned at a point where crimping of the connector and cable have been completed. As described above, this is defined to be when the screws, shown at 30 have come in contact with the surface 28 of the jaw 26 to prevent thereby further closure of said jaws. As can be seen, the pins 48 of the connector lie on either side of the spacer 60, the width of the spacer 60 being such that the pins 48 are not caused to come in contact with the first tool portion 16. This is to prevent deformation of the pins during the crimping process. Note also that the connector body 46 and connector cover 50 are now operatively positioned directly on either side of the cable 52, with the terminals 56 consequently having pierced through the insulation on the cable 52 and properly contacted a conductor therein. The spacing of the pins on either side of the spacer 60 can also be seen in FIG. 4.

From the above description, it can easily be seen that merely by modifying the length of the screws 30, 32, one can accomodate connectors having different thickness and thus different dimensional needs in the proper crimping of the connector to a cable. Further, modifying the width of the spacer 60 enables protection of pins of varying length which also may exist depending on the type of connector being crimped. Variation of the spacing of the various holes 62, 64 in the first tool portion 16, and the holes 72, 74 in the spacer 60, or the addition of a plurality of other holes within these members, enables different sized connectors, e.g. those with a different number of connector pins thereon, to be accommodated with the apparatus of the present invention. Finally, the height of the spacer 60 also can be modified depending on the spacing between the two rows of pins on a given conductor or to take into account a different pin configuration than the pin configuration shown in the drawings. For example, some connectors have all their pins clustered in their center. In such a case, the spacer 60 would necessarily be of a shape to enable clearance of these pins past the spacer 60 while still enabling the spacer 60 to provide secondary spacing means for the connector, to provide protection against damage to the pins thereby.

It is to be understood that the foregoing description is merely illustrative of a preferred embodiment of the invention and that the scope of the invention is not to be limited thereto but is to be determined by the scope of the appended claims.

I claim:

1. A cable connector crimping apparatus for a connector having a plurality of pins, for use in combination with a standard vise or the like having first and second jaws whose front surfaces can be controllably closed together, comprising:

stop means for preventing the vise jaws from closing beyond a certain position corresponding to the point at which crimping of the connector has been completed;

secondary spacing means operatively associated with said stop means for preventing the pins of said connector from being damaged during crimping;

means for positioning said stop means and said secondary spacing means with respect to said front surface of said first jaw of said vise such that as said jaws are closed together, a connector and cable positioned therebetween are crimped together thereby.

2. The crimping apparatus of claim 1 wherein said stop means comprises a plurality of screws, at least two of which are positioned one on either side of a given connector during crimping, said screws oriented such that the heads of these said screws lie flush against the front surface of said first jaw, and oriented such that the opposite end of said screws are positioned to contact the front surface of said second jaw after said second jaw is caused to be shifted closer to said first jaw, to prevent further closure of said jaws thereby.

3. The crimping apparatus of claim 2 wherein said secondary spacing means comprises a spacer sized such that the pins of said connector fit about or on either side of said spacer, the width of said spacer being at least as great as the length of said pins, to act as a stop therefore, to prevent damage to said pins during crimping.

4. The crimping apparatus of claim 3 wherein said means for positioning said stop means comprises a bracket portion including first and second sides, said first side acting to support said bracket portion on said first jaw, such that one surface of said second side of said bracket portion lies substantially flush against the front surface of said first jaw, said bracket portion further defining a plurality of holes defined in said second side such that said screws will fit therethrough in such a way that their heads rest in a substantially flush relationship with said surface of said second side against said front surface of said first jaw, said screws being supported by said bracket portion thereby.

5. The crimping apparatus of claim 4 wherein said spacer includes a plurality of holes defined therein, and wherein said means for positioning said secondary spacing means comprises in combination said bracket portion and said screws, said holes defined in a position on said spacer such that a plurality of said screws extend therethrough to provide vertical support for said spacer, said spacer resting against said second side of said bracket portion to provide horizontal support therefore.

6. The crimping apparatus of claim 3 wherein said stop means and said secondary spacing means are removably associated with said positioning means such that alternative sizes of screws and spacer may be used depending on the size characteristics of the given connector being crimped.

7. A cable connector crimping apparatus for crimping together a connector and cable such that male or female pins on the connector become conductively in contact with corresponding conductors on said cable, and in combination with a standard vise or the like having first and second jaws whose front surfaces can be controllably closed together, comprising:

a first tool portion formed as an L-shaped strip having first and second elongated sides, and oriented such that said first side of said strip rests on top of said first jaw to provide support for said strip, and oriented such that said second side of said strip is positioned substantially adjacent and in contact with said front surface of said first jaw; and stop means operatively connected to said first tool portion, such that said front surface of said second jaw is constrained from closing beyond a certain point towards said first jaw, said point defined to be the position of said jaws at which crimping of a cable to a connector positioned therebetween has been completed.

8. The crimping apparatus of claim 7 further comprising a second tool portion operatively connected to said stop means and said first tool portion, said second tool portion operatively positioned and sized such that said connector pins are not damaged by said crimping.

* * * * *